United States Patent [19]

Sarda

[11] 4,366,754

[45] Jan. 4, 1983

[54] HOLDER FOR INK SEPARATOR ON A DRUM OF A PRINTING PRESS

[76] Inventor: Jean L. Sarda, 25, rue Pradier, 75019 Paris, France

[21] Appl. No.: 253,590

[22] Filed: Apr. 13, 1981

Related U.S. Application Data

[63] Continuation-in-part of Ser. No. 27,829, Apr. 6, 1979, abandoned.

[30] Foreign Application Priority Data

Apr. 7, 1978 [FR] France ..... 78 10437

[51] Int. Cl.[3] ..... B41F 31/04; B41F 31/06

[52] U.S. Cl. ..... 101/208; 101/365; 118/261

[58] Field of Search ..... 101/365, 350, 363, 364, 101/207, 208, 210, 148; 118/261; 15/256.5

[56] References Cited

U.S. PATENT DOCUMENTS

| | | | |
|---|---|---|---|
| 236,566 | 1/1881 | Engels | 101/210 |
| 358,473 | 3/1887 | Nuebling | 101/210 |
| 729,002 | 5/1903 | Spalckhaver | 101/210 |
| 1,105,861 | 8/1914 | Story | 101/365 |
| 1,400,704 | 12/1921 | Welsh | 101/210 |
| 1,433,954 | 10/1922 | Klorer | 101/210 |
| 1,643,145 | 9/1927 | Winkler | 165/90 X |
| 1,699,389 | 1/1929 | Betzinger | 101/210 |
| 1,742,787 | 1/1930 | Rupp | 101/365 |
| 1,893,148 | 1/1933 | Page | 101/210 |
| 1,919,283 | 7/1933 | Troy | 101/210 |
| 1,953,105 | 4/1934 | Flinker | 101/210 |
| 2,018,193 | 10/1935 | Smith | 101/366 |
| 2,525,363 | 10/1950 | Luehrs | 101/210 X |
| 3,198,113 | 8/1965 | Feller | 101/208 |
| 3,913,479 | 10/1975 | Cappel et al. | 101/365 |
| 3,956,986 | 5/1976 | Wirz et al. | 101/350 |

FOREIGN PATENT DOCUMENTS

| | | |
|---|---|---|
| 1275206 | 9/1961 | France . |
| 1341700 | 9/1963 | France . |
| 2194576 | 3/1974 | France . |
| 2018200 | 10/1979 | United Kingdom . |

*Primary Examiner*—J. Reed Fisher

*Attorney, Agent, or Firm*—Wigman & Cohen

[57] ABSTRACT

The present invention relates to a device for feeding ink to a printing press. The invention includes an ink drum and at least one doctor blade for micrometrically proportioning one or more ink films of different colors in narrow zones through a gap provided between the outer surface of the ink drum and the bottom edge of the doctor blade. A key improvement relates to a plurality of holders for carring a plurality of thin plates having contoured edges for acting as seals against the outer surface of the ink drum and against the front face of the doctor blade whereby there is formed a plurality of reservoirs for supplying a plurality of inks simultaneously through a gap provided between the ink drum and the doctor blade. In each holder, an adjustable screw presses against an element which contacts an uncontoured edge of each thin plate. The pressed element may be a captive ball traveling in a groove or a lever pivoted about an axis provided in each holder. This contact by the pressed element against the thin plate causes the contoured edges of the plate to act as seals for forming sides of each ink reservoir.

2 Claims, 12 Drawing Figures

FIG. 2A
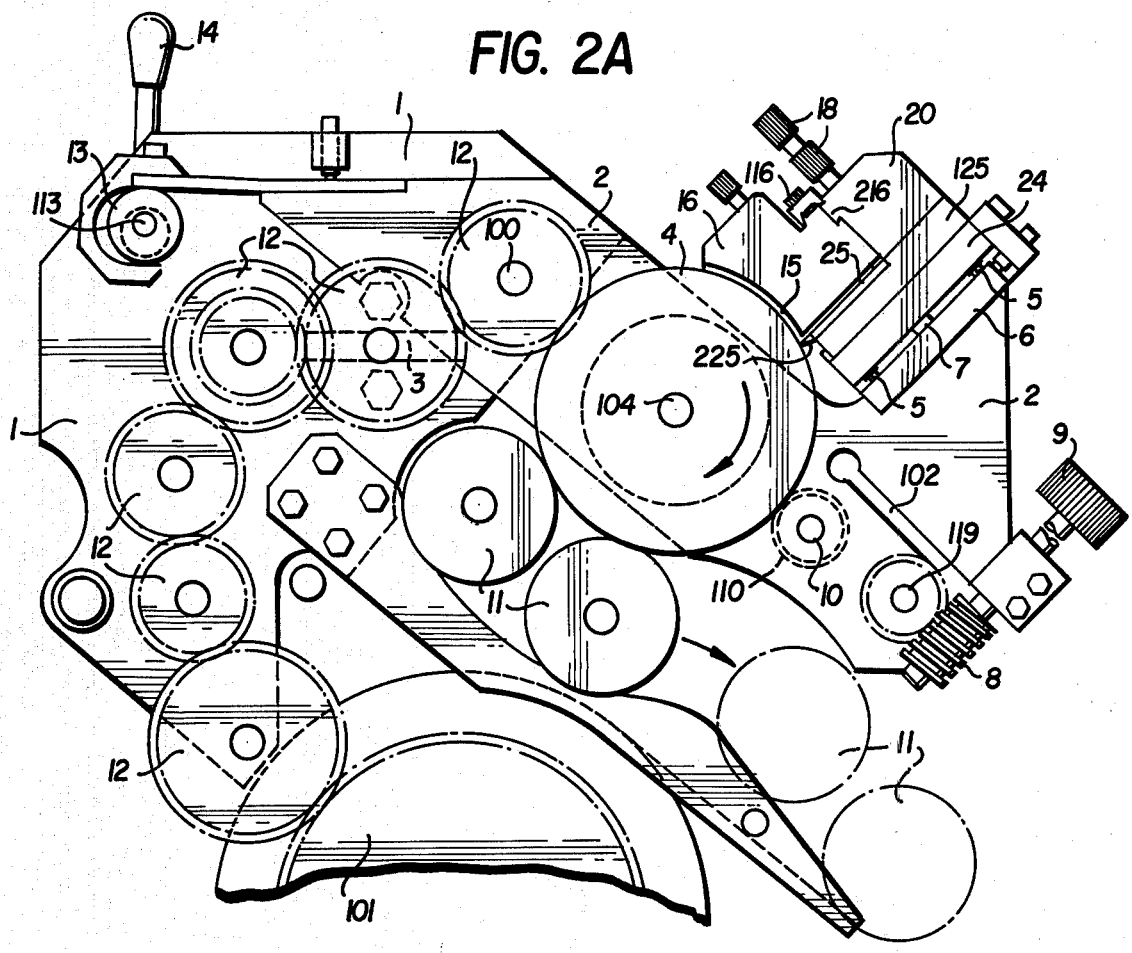
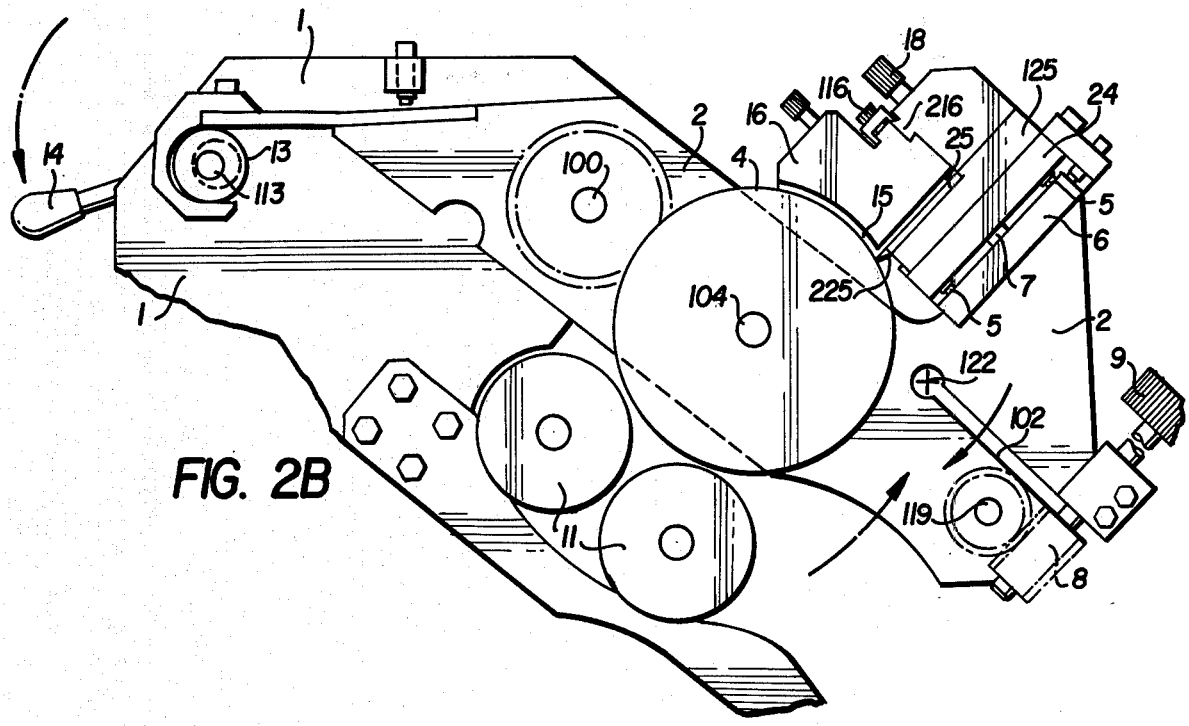
FIG. 2B

HOLDER FOR INK SEPARATOR ON A DRUM OF A PRINTING PRESS

CROSS REFERENCE TO RELATED APPLICATION

This application is a continuation-in-part application of U.S. application Ser. No. 27,829, filed Apr. 6, 1979, now abandoned.

BACKGOUND OF THE INVENTION

1. Field of the Invention

This invention relates to printing presses and, in particular, to a holder for an ink separator on a drum of a printing press. The invention may be used with typographic, offset, flexographic, lithographic and other analogous types of printing presses.

2. Description of the Prior Art

The inking mechanisms used to equip nearly all printing presses are analogous to one another and make possible only the use of one ink per printing. They are constructed and operate as follows: a drum serves as a reservoir and an ink source. Flow is obtained from the reservoir through a gap resulting from the interplay between the deformation of a flexible steel blade and a metal cylinder, called the ink drum, against which the blade presses. The ink flows between the blade and the ink drum and forms at its surface a film of varying thickness depending on the pressure applied to the back of the blade by control screws.

A set of flexible rollers, alternated with metal cylinders, transfers and modifies the ink film to make it ready for inking. Depending on the manufacturer and on the density and quality of inking desired, the number, diameter and arrangement of the rollers and cylinders may vary significantly.

According to this principle of inking, it is possible only approximately to control the thickness of the ink film in zones about 20 mm to 40 mm in width. The advance of the ink drum is generally variable and adjustable.

The film emerging from the reservoir is relatively thick and not suited to high quality printing; it is improved by each distribution roller which thinly spreads, laminates, mixes and homogenizes it. The distributing cylinders take part in and complete this action; they are called "distributors" because of their axial and rotary movement. Area by area, they even out the thickness of the film and prevent annular ridges which might result from ink surface tension.

The film inking the printing portions of presses must be perfectly even and of constant thickness in a given zone. The acceptable tolerance is of the order of 2 to 3 microns above or below the target thickness.

Depending on the holder, the type of printing and various other factors, the ink forming the film must have a particular rheology, which is determined by its ingredients, possible additives, and the mechanical action of the inking device. To a large degree, the quality of the inking determines the quality of the ultimate print.

Conventional inking mechanisms in general make it possible to meet such requirements. In addition to their bulk and clumsiness, however, they present a number of drawbacks:

(1) there is imprecise control of ink film thickness in narrow zones, making the juxtaposition of flat tint printing with small characters quite tricky;

(2) unnecessarily excessive ink consumption occurs when the surface area to be printed is negligible in comparison with the overall printing surface of the machine; this consumption becomes very high when there are a number of short printing runs to be made in succession using different colors; and (3) when printing is first started up, the ink balance is obtained only after a certain number of copies have been printed, thus resulting in paper waste.

Moreover, the basic principle of this type of inking makes it unsuitable for handling different colors of ink in a single printing. Indeed, the so-called distributing cylinders, those which move axially and in rotation, rapdily mix the inks together, and the reservoir does not allow for the release and control of narrow flows of inks of different colors.

In an effort to overcome this limitation, several patents have issued. They all retain the same printing principle and, by means of more or less different methods, advocate the use of dividers in order to create zones of discontinuity at the junctions between the different-colored inks by using circumferential grooves in the axially-moving rollers or the rollers working in tandem, or by scraping up the residual ink which stems from the mixing action of the axially-moving rollers. Examples are shown in U.S. Pat. Nos. 358,473, 729,002, 1,699,389 and 2,525,363. These methods are but palliatives, and are ill-adapted to successive runs which may differ greatly from one to the next and often are quite short in numerical terms. Quite apart from a discussion of the drum, the sole fact of having to use special "distributing rollers" for each different press run gives rise to additional work for the printer, work which in the vast majority of cases is not justified by the time savings achieved and in practice eliminates the advantages of these methods.

Indeed, a printer who desires a multicolored printing is required to treat each color in succession, one after another, which does not require as many passes through the press as it does colors except in three- or four-colored prints using plates where the overlaying of the three primary colors theoretically makes it possible to achieve any tint. However, this type of printing is reserved for specific types of prints and still requires 3 to 4 press runs. This situation makes it difficult to produce multicolor prints at a low cost.

French Pat. Nos. 1,275,206, 1,341,700 and 2,194,576 have proposed solutions aimed at simplifying conventional inking devices by eliminating almost all elements of the sequence of distribution rollers and cylinders. The basic idea in these patents is to create a single, laminated and proportional ink film by pressing together two cylinders, one of them metal and the other covered by a flexible material, so as to ink the offset plate directly. This procedure allows neither for zone-by-zone control of the film thickness nor for the possibility of partitioning off inks of different colors. This system is perhaps sufficient for use in offset work to handle one color or kind of ink per printing, where in theory each point on the plate takes the same quantity of ink, since nearly all offset presses in use are equipped with inking devices with zone-by-zone control screws similar to those used in typography.

In typographic printing, especially in the case of the platen press where pressure control is rather delicate depending on the lubrication of the printing parts and is closely correlated with the inking, it is essential to control the thickness of the ink film zone by zone. Depending on their kind or color, inks have different densities and rheologies, which require different thickness in order to obtain a given inking. To devise an offset or typographic inking mechanism able to handle several inks at once, where each film must be inked individually, it is necessary to take the above factor into account and provide the capacity for adjustment in narrow zones, this so as to make it possible for the printer to use narrow "ribbons" of ink.

Other patents of more general interest for showing the present state of the printing art are U.S. Pat. Nos. 1,643,145, 3,913,479 and 3,956,986.

SUMMARY OF THE INVENTION

It is a primary object of the present invention to provide an improved holder for an ink separator on a drum of a printing press. The basic holder, upon which this improvement is made, is shown and described in Great Britain patent application No. 2 018 200 A, published Oct. 17, 1979.

Generally, this invention relates to an inking mechanism used to create one or several ink films suited for the inking of the printing parts directly on a metal cylinder serving as an ink bed. The thickness of the films in question may be controlled micrometrically, one narrow zone at a time.

This device makes it possible, on the high precision rotary drum, to introduce different colors or kinds of ink directly in different compartments. This drum is preferably cylindrical and inks the inking rollers, which in turn then ink the printing parts.

Another form of the invention uses a special smooth, metallic, non-grooved cylinder which acts as a heat radiator and is covered by a hardened elastomer whose flexibility is virtually uninvolved in the lamination of the ink. In this arrangement, the separators of the present invention may be made of self-lubricating flexible materials, such as teflon, and the elastomer coating on the cylinder may be protected by a varnish so as to protect it at the places where the ink separators are operating.

The inking bed in the device incorporates the metallic cylinder coated by an elastomer for transferring the ink film to the printing plate, with the rolling of this cylinder corresponding strictly to that of the plate holder so that the inking recurs at the same locations with each rotation of the cylinder.

The description which follows makes reference to the accompaying drawings and is provided by way of example. The description relates to one of the numerous applications of the invention and concerns the attachment of an inking device for one or several colors, which inking device may be incorporated on a platen press. This type of inking mechanism, described below, is based on extreme mechanical pressure and requires machining tolerances of the order of 2 to 3 microns greater or lesser than the target for the working parts where the ink film is created and proportioned. The choice and fineness of the steels used also plays an important role in this configuration.

BRIEF DESCRIPTION OF THE DRAWINGS

FIG. 2A is a side elevational view of a second embodiment of the holder and the inking mechanism of the platen printing press embodying the present invention;

FIG. 2B is a cut-away side elevational view of the second embodiment shown in FIG. 2A with the movable parts of the inking mechanism exposed;

DETAILED DESCRIPTION OF THE PREFERRED EMBODIMENTS

Figure 1:
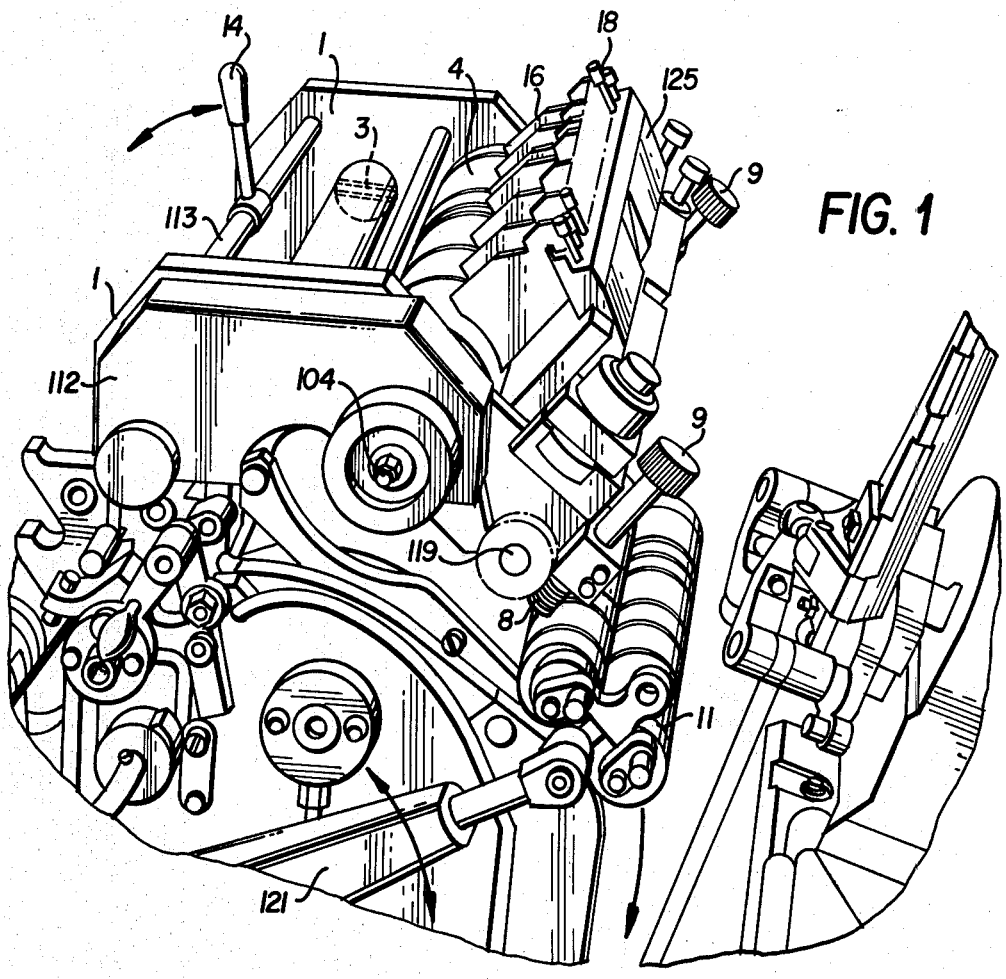
FIG. 1 is a perspective side view of a first embodiment of the holder and the inking mechanism of a platen printing press embodying the present invention.
Figure 4A:
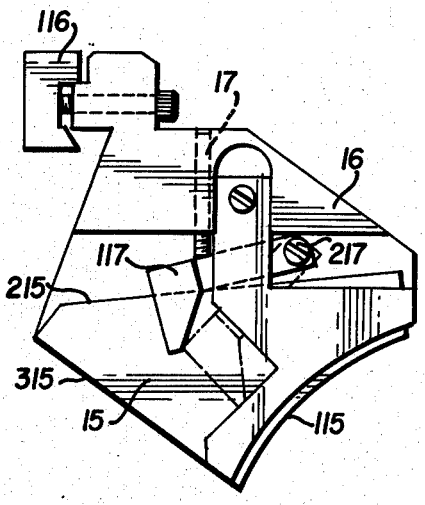
FIG. 4A is a detailed left side view of the first embodiment of the holder of the present invention.
Figure 4B:
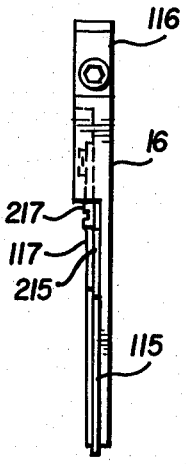
FIG. 4B is a detailed rear view of the first embodiment shown in FIG. 4A.
Figure 6:
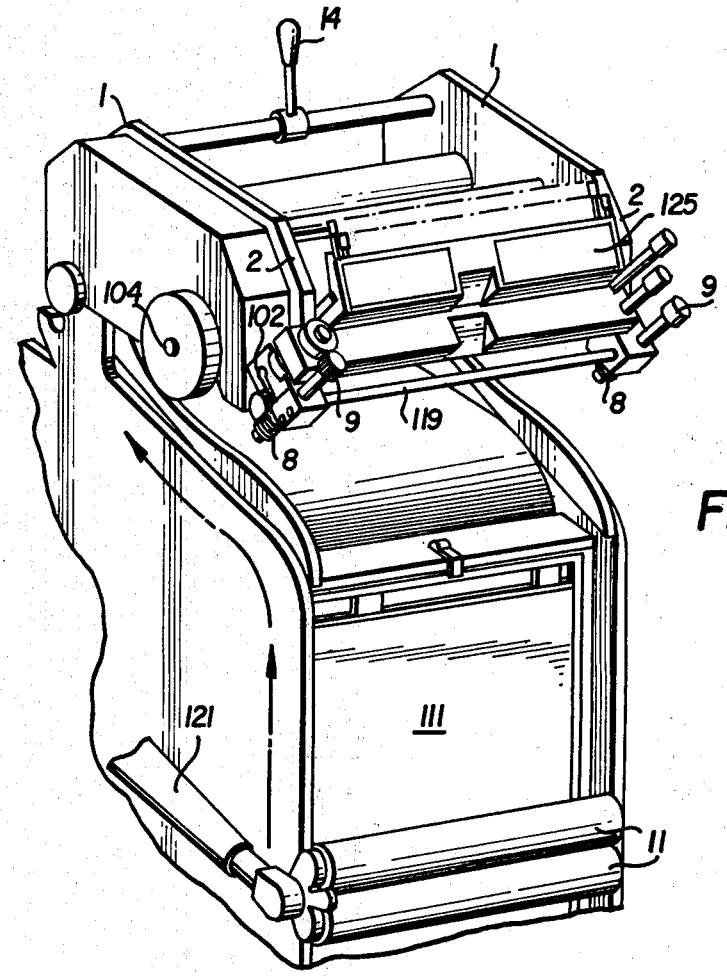
FIG. 6 is a perspective rear side view of the second embodiment of the inking mechanism of the platen printing press embodying the present invention.
Figure 4C:
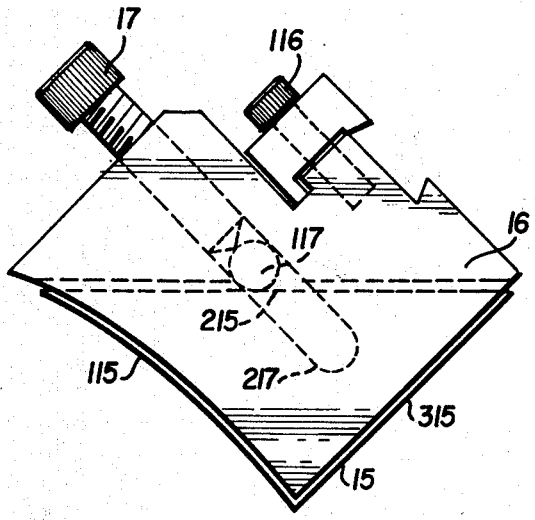
FIG. 4C is a cut-away detailed right side view of the second embodiment of the holder of the present invention.
Figure 4D:
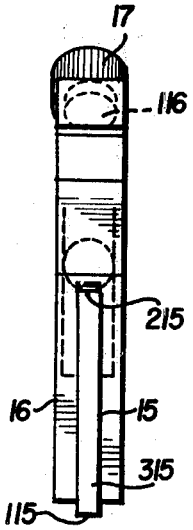
FIG. 4D is a detailed rear view of the second embodiment shown in FIG. 4C.

Referring first to FIGS. 1 and 2A, it may be seen that, in both embodiments, the inking mechanism has a frame comprising two side plates 1, rigidly interconnected by a keyed cross-member 3, shown in phantom lines only, since it lies between the two side plates 1. The frame also includes two movable side plates 2 which are connected to the side plates 1 for pivoting about an axis 100, shown only in FIG. 2A. This pivoting is controlled by an eccentric 13 carried on each end of a cross shaft 113 which, in turn, carries a hand control lever 14. An ink drum 4, which has a polished, chromium-plated surface, is rotatably supported by means of bearings 28, shown in FIG. 3, between the side plates 2. The press also includes two distributing ink rollers 11 shown in FIGS. 1, 2A, 2B and 6. When the hand lever 14 is in the position shown in FIG. 2A, the rollers 11 are in contact with the ink drum 4 so that ink is transferred from the ink drum 4 to the rollers 11 as these components rotate. The rollers 11 are then moved by hydraulic arm 121, shown in FIGS. 1 and 6, so that the ink is transferred to the printing block 111 shown only in FIG. 6. If inking is to be interrupted, the hand lever 14 is rotated, as shown in FIG. 2B, so that eccentric 13 lifts the ink drum 4 out of contact with the distributing rollers 11.

FIG. 2A also shows a gear train 12, lying outside the side plates 1 and 2, for connecting the ink drum 4 with the platen 101 in order to synchronize the movement of ink and paper. A cover plate 112, shown only in FIG. 1, protects the gear train 12 against dust and dirt.

Figure 3:
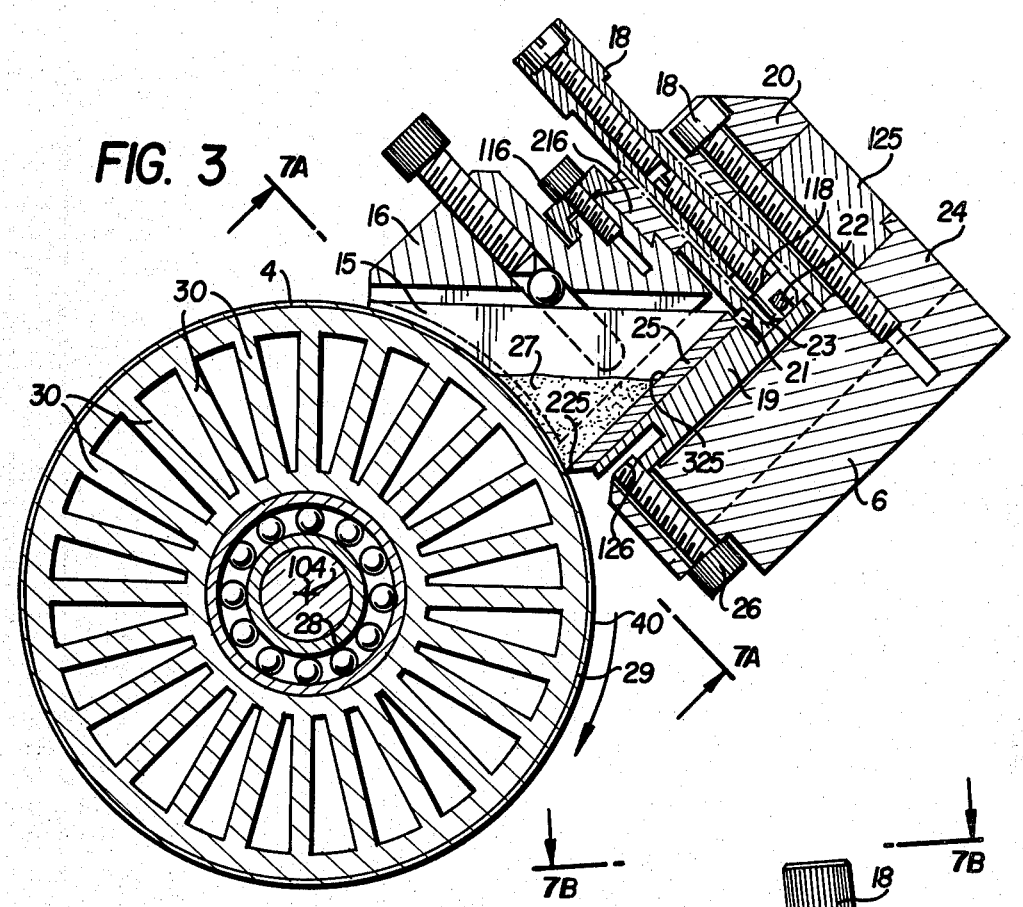
FIG. 3 is a cut-away close-up, right side view of the second embodiment of the holder of the present invention.

To provide the supply of ink which is to be transferred by the ink drum 4 to the inking rollers 11, a doctor blade assembly 125 is mounted between the movable side plates 2. The assembly 125 includes a doctor blade edge 225, shown in FIGS. 2A, 2B, 3 and 5, which almost but not quite contacts the outer surface 40, best shown in FIGS. 3 and 5, of the ink drum 4 at about the two o'clock position. Ink is fed either automatically or manually, into an ink supply reservoir 27, shown in FIGS. 3 and 5, above the doctor blade edge 225. In operation, the ink drum 4 rotates clockwise, as best seen in FIGS. 2A, 3 and 5, so that the outer surface 40 of the drum 4 passing under the doctor blade edge 225 carries with it a film of ink whose thickness is controlled by the amount of spacing between the doctor blade edge 225 and the outer surface 40 of the ink drum 4.

If the ink film requires homogenization, for example, because the ink contains some kind of impurity, a rubber-covered roller 10, shown in FIG. 2A, is arranged to roll over the ink film as it is carried from the doctor blade edge 225 to the distributing rollers 11. A rubber covering 110 on the roller 10 may have a hardness of about 70 Shore units.

Referring back to FIGS. 3 and 5, the doctor blade assembly 125 will be described in greater detail. The base of the assembly 125 is a cross-member 24, which is held in place on the frame of the printing press by securing screws 7, partially shown only in FIGS. 2A and 2B. At each end of the cross-member 24, there are adjustable screws 5, also partially seen in FIGS. 2A and 2B, but better illustrated in FIGS. 7A and 7B. Screws 5 adjust cross-member 24 against abutment 6 which is attached directly to the movable side plates 2, as best shown in FIGS. 2A and 2B. Thus, by adjusting the screws 5 before the securing screws 7 are tightened, the position of the entire doctor blade assembly 125 may be changed. The screws 5 are normally adjusted only when the inking mechanism is first assembled on the printing press. Other adjustments, to be described hereinafter, are provided for changing the gap spacing between the doctor blade edge 225 and the outer surface 40 of the ink drum 4 during normal operation. By removing the securing screws 7, the doctor blade assembly 125 can be removed from attachment to the side plates 2 for general cleaning purposes.

Figure 5:
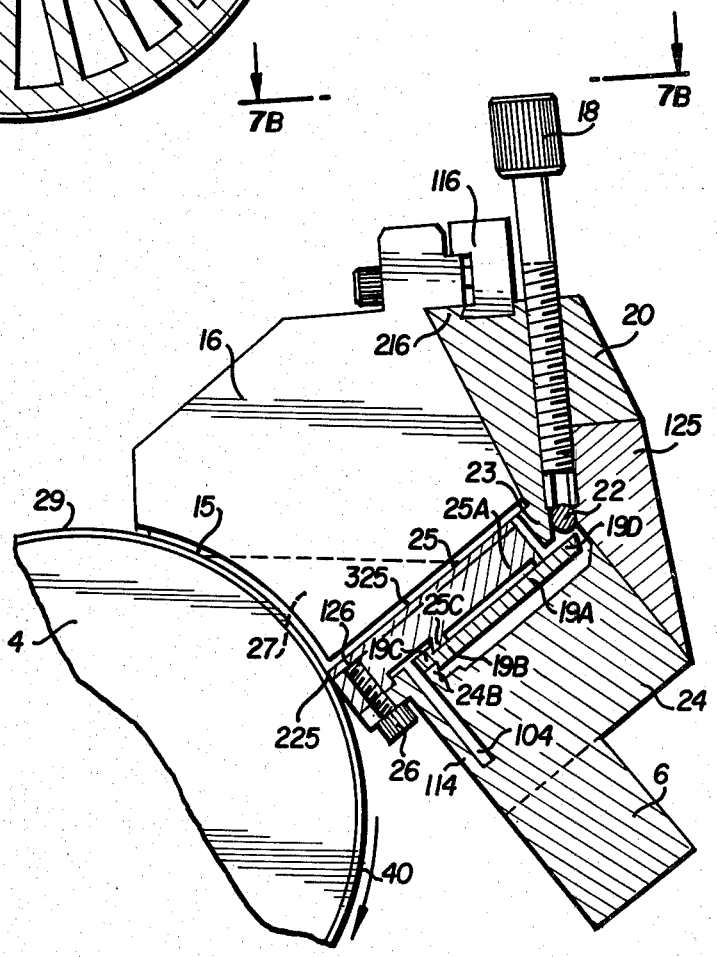
FIG. 5 is a partially cut-away, close-up, right side view of the first embodiment of the holder of the present invention.
Figure 7A:
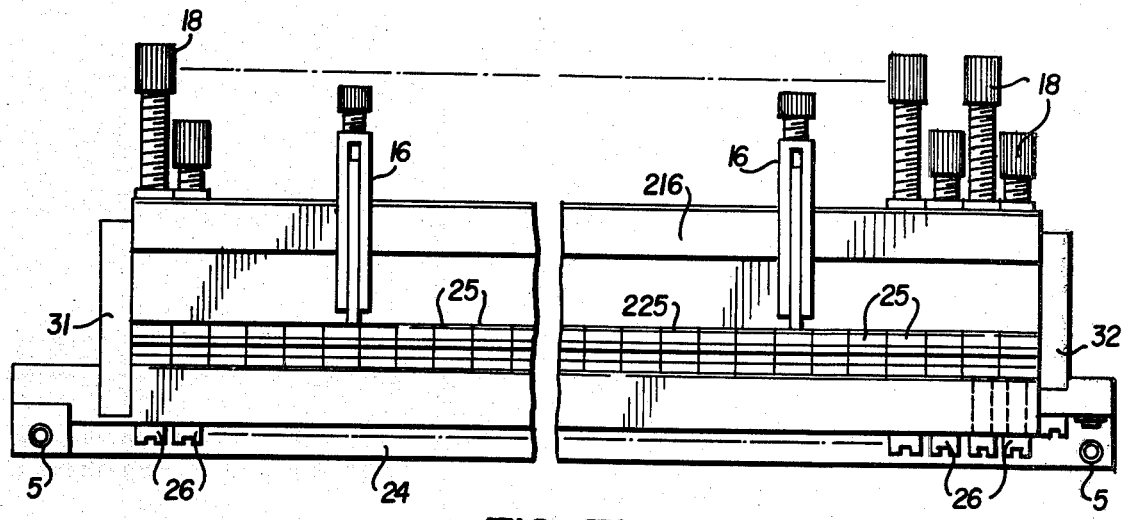
FIG. 7A is a bottom elevational view taken along line 7A—7A of FIG. 3 showing the first embodiment of the holder and the inking mechanism of the present invention.
Figure 7B:
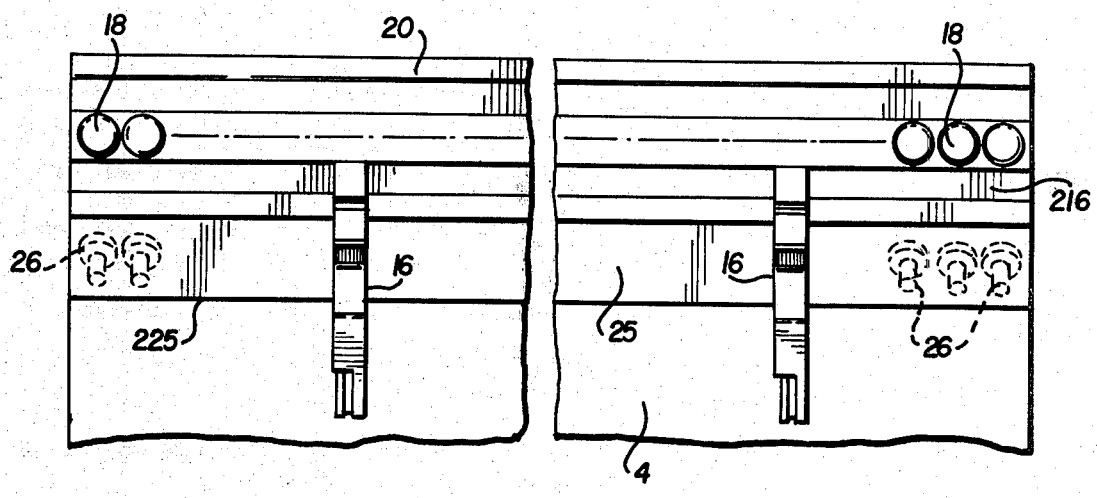
FIG. 7B is an overhead plan view taken along line 7B—7B of FIG. 5 showing the second embodiment of the holder and the inking mechanism of the present invention.

Referring now to the front view in FIG. 7A which corresponds to the side view in FIG. 5, the doctor blade edge 225 may be provided by a plurality of narrow doctor blades 25. Alternately, as shown in FIG. 7B, there may be a single longitudinal doctor blade 25. In the example presented in FIG. 7A, 17 blades are shown but up to 35 blades may be used. Each blade 25 may be between 5 and 10 millimeters wide. Each blade 25 is secured to the cross-member 24 by a screw 26, shown in phantom lines in FIG. 7A. The end screw 26 is better seen in FIG. 5 and may enter a tapped hole in cross-member 24. Each blade 25 is made of spring steel, so that, by elastic flexing of each thin blade 25, the main upper part of each blade 25 can effectively pivot around the end region 126, shown in FIG. 5, of the screw 26. This movement results in an adjustment of the clearance between the edge 225 of each individual doctor blade 25 and the outer surface 40 of the ink drum 4.

This movement is also controlled by the setting of each adjusting screw 19. A separate adjusting screw 18 is provided for each doctor blade 25 so that each blade 25 can be adjusted without affecting the adjacent blades 25. To allow the doctor blades 25 to be finely adjusted, each screw 18 forms part of a differential screw arrangement. Still referring to FIG. 5, the adjusting screws 18 are received in a row of threaded holes formed in a transverse bar 20 which is secured by conventional screws (not shown) to the cross-member 24.

Referring now to FIGS. 3 and 7B which show the second embodiment of the invention, each screw 18 has a topped axial bore in which is received a pressure screw 118, shown only in FIG. 3, which bears against a step-down lever 19. A rod 22 passes transversely through a slot formed in the lower end of each pressure screw 118 in order to prevent screws 118 from rotating. The pitches of screw 18 and 118 are slightly different so that one turn of the screw 18 will shift the main upper part of the doctor blade 25 by only a small distance. This movement results in an even smaller change in the gap between the edge 225 of the doctor blade 25 and the outer surface 40 of the ink drum 4.

The doctor blade 25 has a position to which it returns when the screws 18 and 118 exert no pressure on it. With the doctor blade 25 in the position shown in FIG. 3, the gap between the doctor blade edge 225 and the outer surface 40 of the ink drum 4 is constant across the length of the ink drum 4.

Alternately, to allow this gap to be adjusted as a whole, as opposed to adjusting the screws 18 one at a time, each movable side plate 2 has a slot 102, shown best in FIG. 2B, so that the upper part of the plates 2 carrying the doctor blade assembly 125 may be incrementally moved near to and away from the ink drum 4 by pivoting about axis 122. A tightening screw 8 with a hand control 9 are outerconnected at each side of the press, by a cross-bar 119 shown also in FIG. 6, in order to produce this incrementally controlled movement of the whole doctor blade assembly 125. The mechanism is so set up that, when the doctor blade edge 225 is brought to its position closest to the outer surface 40 of the ink drum 4, there is still a clearance of about 5 microns therefrom. It is important to avoid contact of the edge 225 with the drum 4 in order to allow the ink film to flow therebetween and also to prevent wearing and heating of both elements.

As best shown in FIG. 7A, the individual doctor blades 25 are contained between a left-hand abutment 31 and a right-hand abutment 32 which act to keep the blades 25 in contact with one another along their thin side edges so that ink does not pass between them. When the doctor blades 25 are assembled together, the abutment 31 is first fixed in position at one end. Then, the doctor blades 25 are fixed, one at a time, by the screws 26, working from left to right away from abutment 31 until, finally, the abutment 32 is secured in position at the opposite end.

In the second embodiment shown in FIG. 3, a longitudinal seal 21, shown in cross-section only, is positioned in a groove along the entire length of the transverse bar 20 and prevent the entry of dust and dirt into the area at the bottom end of the pressure screw 118.

If it is desired to use inks of different colors in different parts of the printing area, which parts are spaced laterally from one another in a direction parallel to the longitudinal axis 104 of the ink drum 4, the space which contains the ink supply reservoir 27 is divided by separators 15, best shown in FIGS. 3 and 5, each carried in a separator holder 16. Each holder 16 is held by an adjustable clamp 116 to a dovetail 216 on the transverse bar 20. This arrangement allows the position of each holder 16 to be adjusted transversely along bar 20 by sliding therealong, as shown in FIGS. 7A and 7B.

FIGS. 4A, 4B, 4C and 4D show how each separator 15 is a thin plate which is received in a vertical slot in the respective separator holder 16. A first contoured edge 115 of each separator 15 matches the cross-sectional shape of the outer surface 40 of the ink drum 4. An adjustable screw 17 presses an element 117 against an uncontoured edge 215 of the separator 15 so that the first contoured edge 115 is pressed into contact with the outer surface 40 of the ink drum 4. In the first embodiment of the holder 16 shown in FIGS. 4A and 4B, the pressed element 117 is a lever which pivots about an axis through a screw 217. In the second embodiment of the holder shown in FIGS. 4C and 4D, the pressed element 117 is a captive ball which travels back and forth in a groove 217. There is a second contoured edge 315 which is pressed by the element 117 against the front face 325 of the doctor blade 25, as best shown in FIGS. 3 and 5. In both embodiments, the pressed element 117 is a key improvement which permits better sealing by the separator 15 against the outer surface 40 of the ink drum 4 and also against the front face 325 of the doctor blade 25.

The separators 15 may be made of rigid or semi-rigid material, such as polyurethane or high molecular-weight polyethylene, and may be lubricated during printing by, for example, a wick, in order to reduce wearing and heating. Alternately, the separators 15 may be made of a micro-porous material which, before use, is impregnated with either a wax, a lubricating fluid, or an ink-repellent, such as silicone. Ink from the reservoir 27 may also be efficiently repelled from a separator 15 by water thinly applied thereto.

The following is an example of a separator material which causes very little heating of the ink drum 4. Felt weighing about 500 grams for a sheet one meter long, one meter wide, and one millimeter thick is impregnated with a solution containing 15% of either polyurethane, a polyurethane copolymer or an epoxy resin, in order to fix the fibers of the felt. The felt is next impregnated with wax melting at about 90° C. After cooling, the material is cut into the shape of the separator 15 and finished by machining. The edges 115 and 315 of the separator 15 are coated by immersion in a hard mastic which can maintain contact with the outer surface 40 of the ink drum 4 and with the front face 325 of the doctor blade 25, despite the presence of ink thereon, and will ensure complete sealing of the ink reservoir 27. The mastic has a wax and resin base.

FIG. 3 best shows the construction of the ink drum 4. The outer surface 40 of the drum 4 is formed on a sleeve 29 which, as mentioned above, is covered with polished chromium plating having a thickness of only a few tenths of a millimeter. The purpose of the chromium plating is to improve the adhesion of the ink to the outer surface 40. Inside the sleeve 29, vanes 30 are provided to help in dissipating any heat generated by rolling of the ink by roller 10, shown in FIG. 2A, or by friction resulting from the edges 315 of the separators 15 rubbing over the outer surface 40 of the ink drum 4.

FIG. 5 shows the first embodiment of the doctor blade assembly 125 whose base is the cross-member 24 secured in position on the printing press in substantially the same way as the cross-member 24 shown in FIG. 3. Individual doctor blades 25 are secured to the cross-member 24 by backings 25A through screws 26. The bottom edge 225 of each doctor blade 25 cooperates with the outer surface 40 of the ink drum 4 to define a gap controlling the thickness of the film of ink passing under the edge 225. In this embodiment, the backings 25A are substantially rigid. A deep slot 104 is formed in the cross-member 24 in order to leave a thin plate 114 to which the doctor blades 25 are secured at the left edge thereof by screws 26. Thus, the flexibility of the plate 114 allows the doctor blades 25 to move slightly above the outer surface 40 of the ink drum 4. To produce this movement, a step-down lever 19A is provided for each blade 25 and has steps near its upper and lower ends. One of the lower steps 19B cooperates with a knife-edge 24B on the cross-member 24 while the other lower step 19C cooperates with a knife edge 25C on the backing 25A of each doctor blade 25. Thus, a movement to the right by the free upper end 19D of the lever 19A, upon application of force by screw 18, will cause the associated doctor blade 25 to move slightly to the left. Each adjusting screw 18 acts through a steel ball 22 which may rest against the upper free end 19D of each lever 19A in order to allow the position of each doctor blade 25 to be controlled.

In the first embodiment shown in FIG. 7A, a plurality of doctor blades 25 may be used. In the second embodiment shown in FIG. 7B, a single doctor blade 25 is used and is illustrated as extending across the entire length of the transverse bar 20. When more than one kind of ink is being used with the separators 15 dividing the length of the ink drum 4 into different inking zones, the thicknesses of the ink films are not adjusted separately but are all adjusted to the same thickness in the various inking zones.

The mechanisms described above allow a very fine adjustment of the thickness of each ink film in different inking zones. For example, one turn of the adjusting screw 18 may result in a change in the thickness of the ink film by about ten microns so that it is readily possible to change the film thickness by no more than one micron by less than a full turn of the adjusting screw 18. However, it will be appreciated that, in order to achieve this fine adjustment, the components of the inking mechanism must be very precisely made. Many of the components, such as the doctor blade 25, must be hardened and ground. The outer surface 40 of the ink drum 4 is ground and polished after being plated with chromium. The operative edges 225 of the doctor blades 25 are also finely polished. The bearings 28, shown in FIG. 3, which carry the ink drum 4, are double-row precision bearings that automatically take up any play. Care must be taken when assembling the doctor blades 25 that no foreign matter is present thereon. This may be accomplished before mounting by dipping each blade 25 in a solvent and then drying each one with compressed air.

Further modifications of the inking mechanism are also possible. For example, the outer surface 40 of the ink drum 4 may be provided with a hard elastomeric coating instead of with a chromium plating. Also, the printing plate 111, shown in FIG. 6, may be positioned directly under the ink drum 4 for inking directly without the use of the intermediate distributing rollers 11. In another example, the separators 15 may be made of a flexible self-lubricating material, such as polytetrafluoroethylene, and the elastomeric coating on the outer surface 40 of the ink drum 4 can be protected with a varnish in those regions which are contacted by the separators 15.

As an alternative to the use of the distributing ink rollers 11, ink may be transferred from the ink drum 4 to the printing plate 11, repositioned directly thereunder, by a single cylinder, preferably having an elastomeric covering, whose axis remains stationary and which is geared to rotate in step with other parts of the printing press.

As mentioned above, if the single longitudinal doctor blade 25 shown in FIG. 7B is used, the thickness of the ink film cannot be individually adjusted in different inking zones. Instead, the pigment density of each ink may be adjusted so that the use of ink films of the same thickness produces different color tints in the printed article. This adjustment may be achieved by starting with inks having a high pigment concentration. The thickness of the ink film is adjusted so that the color is "correct" in those areas of the printed article which require the densest tint. The remaining areas will, of course, be too dense but the tints may be changed by diluting the inks for those areas.

It would also be possible to modify the density of the inks by starting with thin inks and adding pigments thereto in order to increase their thickness. For example, gel-like pigments may be incorporated into the thin inks in order to thicken them before printing. Of course, the amount and type of gel-like pigments depends upon the nature of the paper and the kinds of inks used.

Also, where water is needed in the printing press, various kinds of conventional dispensers may be used, particularly for offset or lighographic presses. Although some dispensers are used mainly for semi-professional machines and directly dilute the ink with water, most professional machines use one or more damping rollers, which may supply water to the ink drum 4 or to other parts of the press. Some such damping rollers are driven only in rotation while others are driven both in rotation and in translatory motion, i.e., shifting sideways across the ink drum 4. However, if it is desired to process different kinds or colors of ink simultaneously, it is essential that the damping rollers should not move in translatory motion in order to prevent water contaminated with one color of ink from being brought into contact with ink having a different color.

The foregoing preferred embodiments are considered as illustrative only. Numerous other modifications and changes will readily occur to those skilled in the art of printing and, consequently, the disclosed invention is not limited to the exact constructions and operations shown and described hereinabove.

I claim:

1. A device for inking a printing press, including:

a frame;

a single, rotatable, non-grooved ink drum mounted on the frame;

at least one doctor blade movable across the outer surface of the ink drum;

means, mounted on the frame, for carrying the at least one doctor blade above the ink drum; and means for adjusting a gap provided between the outer surface of the ink drum and the bottom edge of the at least one doctor blade;

wherein the improvement comprises:

a plurality of means for separating a plurality of inks along the outer surface of the ink drum, each separating means having a first contoured edge for contacting against the outer surface of the ink drum, a second contoured edge for contacting against the front face of the at least one doctor blade, and a third uncontoured edge;

a plurality of means, detachably mounted to the carrying means, for holding the plurality of separating means;

a plurality of clamp means, detachably engaged with the carrying means, for adjusting the position of each of the plurality of holding means transversely along the carrying means by sliding therealong;

said carrying means includes a transverse bar and a dovetail means for engaging with the plurality of clamp means;

an element pressed into contact with the third uncontoured edge of each separating means; and means, carried by the holding means, for pressing against the pressed element so that the first contoured edge of each separating means acts as a seal against the outer surface of the ink drum and the second contoured edge of each separating means acts simultaneously as a seal against the front face of the at least one doctor blade;

wherein said pressed element is a captive ball traveling in a groove;

wherein said pressing means is an adjustable screw;

wherein said plurality of separating means are a plurality of thin plates;

whereby there is formed a plurality of reservoir means for supplying a plurality of inks to flow through the gap provided between the outer surface of the ink drum and the bottom edge of the at least one doctor blade.

2. A device for inking a printing press, including:

a frame;

a single, rotatable, non-grooved ink drum mounted on the frame;

at least one doctor blade movable across the outer surface of the ink drum;

means, mounted on the frame, for carrying the at least one doctor blade above the ink drum; and means for adjusting a gap provided between the outer surface of the ink drum and the bottom edge of the at least one doctor blade;

wherein the improvement comprises:

a plurality of means for separating a plurality of inks along the outer surface of the ink drum, each separating means having a first countoured edge for contacting against the outer surface of the ink drum, a second contoured edge for contacting against the front face of the at least one doctor blade, and a third uncontoured edge;

a plurality of means, detachably mounted to the carrying means, for holding the plurality of separating means;

a plurality of clamp means, detachably engaged with the carrying means, for adjusting the position of each of the plurality of holding means transversely along the carrying means by sliding therealong;

said carrying means includes a transverse bar and a dovetail means for engaging with the plurality of clamp means;

an element pressed into contact with the third uncontoured edge of each separating means; and means, carried by the holding means, for pressing against the pressed element so that the first contoured edge of each separating means acts as a seal against the outer surface of the ink drum and the second contoured edge of each separating means acts simultaneously as a seal against the front face of the at least one doctor blade;

wherein said pressed element is a lever means for pivoting about an axis provided in the holding means;

wherein said pressing means is an adjustable screw;

wherein said plurality of separating means is a plurality of thin plates;

whereby there is formed a plurality of reservoir means for supplying a plurality of inks to flow through the gap provided between the outer surface of the ink drum and the bottom edge of the at least one doctor blade.

* * * * *